US006895209B2

(12) United States Patent
Kawahara et al.

(10) Patent No.: US 6,895,209 B2
(45) Date of Patent: May 17, 2005

(54) CLEANING DEVICE AND IMAGE FORMING APPARATUS USING THE SAME

(75) Inventors: Shinichi Kawahara, Tokyo (JP); Satoshi Takano, Tokyo (JP); Hiroshi Saitoh, Chiba (JP); Toshihiro Sugiyama, Tokyo (JP); Hirokazu Ishii, Tokyo (JP); Yuji Arai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/418,111

(22) Filed: Apr. 18, 2003

(65) Prior Publication Data

US 2003/0219289 A1 Nov. 27, 2003

(30) Foreign Application Priority Data

Apr. 19, 2002 (JP) ..... 2002-118159
Jun. 28, 2002 (JP) ..... 2002-189498

(51) Int. Cl.[7] ..... G03G 21/00
(52) U.S. Cl. ..... 399/353
(58) Field of Search ..... 399/101, 149, 399/175, 343, 349, 353, 354, 355

(56) References Cited

U.S. PATENT DOCUMENTS

| | | | | |
|---|---|---|---|---|
| 4,607,936 A | | 8/1986 | Miyakawa et al. | |
| 4,755,853 A | * | 7/1988 | Shimizu et al. | 399/354 |
| 5,083,169 A | | 1/1992 | Usui et al. | |
| 5,111,251 A | * | 5/1992 | Uno et al. | 399/349 |
| 5,606,408 A | * | 2/1997 | Yano et al. | 399/343 |
| 5,617,191 A | | 4/1997 | Murakami et al. | |
| 5,799,229 A | | 8/1998 | Yokoyama et al. | |
| 5,812,919 A | | 9/1998 | Takano et al. | |
| 5,819,138 A | | 10/1998 | Hashizume | |
| 5,822,667 A | | 10/1998 | Hayama et al. | |
| 5,826,144 A | | 10/1998 | Takenaka et al. | |
| 5,879,752 A | | 3/1999 | Murakami et al. | |

(Continued)

FOREIGN PATENT DOCUMENTS

| | | | | |
|---|---|---|---|---|
| JP | 03191379 A | * | 8/1991 | G03G/21/00 |
| JP | 09050215 A | * | 2/1997 | G03G/21/00 |
| JP | 10-26916 | | 1/1998 | |
| JP | 10282854 A | * | 10/1998 | G03G/21/10 |

OTHER PUBLICATIONS

U.S. Appl. No. 10/792,694, filed Mar. 5, 2004, Tsuda et al.
U.S. Appl. No. 10/859,292, filed Jun. 3, 2004, Tsuda et al.
U.S. Appl. No. 10/861,495, filed Jun. 7, 2004, Suda et al.
U.S. Appl. No. 10/636,637, filed Aug. 8, 2003, Hosokawa et al.
U.S. Appl. No. 10/637,690, filed Aug. 11, 2003, Shindoh et al.
U.S. Appl. No. 10/667,301, filed Sep. 23, 2003, Tsuda et al.
U.S. Appl. No. 10/660,636, filed Sep. 12, 2003, Ishii et al.
U.S. Appl. No. 10/665,494, filed Sep. 22, 2003, Kawasumi et al.
U.S. Appl. No. 10/692,792, filed Oct. 27, 2003, Kizaki et al.
U.S. Appl. No. 10/694,062, filed Oct. 28, 2003, Kizaki et al.
U.S. Appl. No. 10/742,835, filed Dec. 23, 2003, Tsuda et al.
U.S. Appl. No. 10/740,665, filed Dec. 22, 2003, Nagashima et al.
U.S. Appl. No. 09/996,752, filed Nov. 30, 2001, Arai et al.
U.S. Appl. No. 10/042,147, filed Jan. 11, 2002, Chikano.
U.S. Appl. No. 10/101,978, filed Mar. 21, 2002, Sugiyama et al.

(Continued)

*Primary Examiner*—Robert Beatty
(74) *Attorney, Agent, or Firm*—Oblon, Spivak, McClelland, Maier & Neustadt, P.C.

(57) ABSTRACT

A cleaning device for cleaning an image carrier by removing toner and other residues left thereon of the present invention includes a brush having tips, which contact the surface of the image carrier, provided with a loop configuration and a contact pressure of 50 g/cm$^2$. A toner collecting space is located at a position adjacent to the brush and at which the tips of the brush contacted the surface of the image carrier arrive in accordance with the movement of the brush.

20 Claims, 17 Drawing Sheets

U.S. PATENT DOCUMENTS

| | | | | | |
|---|---|---|---|---|---|
| 5,897,243 | A | | 4/1999 | Komatsubara | |
| 5,909,609 | A | | 6/1999 | Yahata et al. | |
| 5,923,936 | A | | 7/1999 | Tanoue et al. | |
| 5,930,573 | A | | 7/1999 | Miyamoto et al. | |
| 5,950,055 | A | | 9/1999 | Yahata et al. | |
| 5,950,062 | A | | 9/1999 | Yahata et al. | |
| 6,112,046 | A | | 8/2000 | Suzuki et al. | |
| 6,160,977 | A | * | 12/2000 | Takeichi et al. | 399/127 |
| 6,188,862 | B1 | | 2/2001 | Ishii | |
| 6,219,505 | B1 | * | 4/2001 | Sato et al. | 399/98 |
| 6,282,386 | B1 | | 8/2001 | Ishii | |
| 6,337,957 | B1 | | 1/2002 | Tamaki et al. | |
| 6,363,237 | B1 | * | 3/2002 | Nagame et al. | 399/343 |
| 6,415,129 | B2 | * | 7/2002 | Sawayama | 399/353 |
| 6,421,511 | B2 | | 7/2002 | Sugiyama et al. | |
| 6,424,813 | B1 | * | 7/2002 | Hatakeyama | 399/279 |
| 6,430,383 | B1 | | 8/2002 | Sugiyama et al. | |
| 6,442,367 | B1 | * | 8/2002 | Itami et al. | 399/349 |
| 6,522,855 | B1 | | 2/2003 | Katoh et al. | |
| 6,532,355 | B2 | | 3/2003 | Saitoh et al. | |
| 6,597,885 | B2 | * | 7/2003 | Kai et al. | 399/277 |
| 2001/0022910 | A1 | | 9/2001 | Sawayama | |

OTHER PUBLICATIONS

U.S. Appl. No. 10/092,488, filed Mar. 8, 2002, Arai et al.
U.S. Appl. No. 10/159,110, filed Jun. 3, 2002, Akiba.
U.S. Appl. No. 10/188,754, filed Jul. 5, 2002, Terai.
U.S. Appl. No. 10/219,739, filed Aug. 6, 2002, Ishii
U.S. Appl. No. 10/259,330, filed Sep. 30, 2002, Motegi.
U.S. Appl. No. 10/921,923, filed Aug. 20, 2004, Koike et al.

* cited by examiner

FIG. 10

| PRESSURE (gf/cm²) | CLEANABILITY |
|---|---|
| 20 | × |
| 40 | × |
| 50 | ○ |
| 70 | ○ |

FIG. 11

| μ | CLEANABILITY |
|---|---|
| 0.1 | × |
| 0.2 | ○ |
| 0.3 | ○ |
| 0.4 | ○ |

CLEANING DEVICE AND IMAGE FORMING APPARATUS USING THE SAME

BACKGROUND OF THE INVENTION

1. Field of the Invention

The present invention relates to a copier, printer, facsimile apparatus or similar electrophotographic image forming apparatus and more particularly to a cleaning device included in an image forming apparatus for removing various residues, including toner contained in a developer, paper dust and additives contained in toner and a sheet, left on a photoconductive element or similar image carrier after image transfer.

2. Description of the Background Art

Generally, an electrophotographic image forming apparatus includes a photoconductive element, which is a specific form of an image carrier. A charging step and an image writing step are sequentially executed with the photoconductive element to form a latent image thereon. Subsequently, the latent image is developed by a developing step using toner to become a toner image. The toner image is transferred to a sheet or recording medium by an image transferring step and then fixed on the sheet by a fixing step.

In the image transferring step, the toner image is not entirely transferred from the photoconductive element to a sheet, but is partly left on the photoconductive element. The image transferring step is therefore followed by a cleaning step for removing the toner and other residues, i.e., paper dust, rosin, Mg, Al, K, Na and other additives contained in the sheet from the photoconductive element together with residual charges, thereby preparing the photoconductive element for the next image formation. Also left on the photoconductive element after image transfer are additives contained in the toner for implementing chargeability, fixability, fluidity and other characteristics required of the toner. Further, discharge products derived from, e.g., corona discharge are removed from the photoconductive element by the cleaning step.

A cleaning device for effecting the cleaning step may include a blade contacting the photoconductive element and a rotatable brush having looped tips held in rubbing contact with the photoconductive element, as taught in, e.g., Japanese Utility Model Laid-Open Publication Nos. 2-149969 and 2-140563 and Japanese Utility Model Publication No. 7-33260. The blade and brush are so configured and arranged to damage the photoconductive element little when removing the residues.

In the cleaning device described above, the brush needs certain pressure for scraping off the residues from the photoconductive element. It has been reported that the brush can efficiently remove the residues when contacting the photoconductive drum with pressure of 50 g/cm$^2$ or above. This pressure refers to one that causes the tips of the brush bite into the surface of the photoconductive drum by a preselected amount.

When the brush is constantly held in contact with the photoconductive element, the following problems arise, depending on the amount of residues left on the photoconductive element. The residues removed by the brush and blade are conveyed thereby and then collected. However, when the amount of image formation effected on the photoconductive element, i.e., when an image with a small area ratio is repeatedly formed on the photoconductive element, the amount of residues to reach the cleaning device decreases little by little. Consequently, when the residues to be removed are absent or almost absent on the brush or cleaning member, the brush directly contacts the photoconductive element and charges it by triboelectrification, thereby making a charge distribution, including background potential, irregular.

The looped tips of the brush have greater bending strength than fur-like tips and therefore tend to rub the photoconductive element with higher pressure, aggravating triboelectrification on the photoconductive element. The resulting charge is apt to work as restraint on the residues left on the photoconductive element, obstructing the removal of the residues. As a result, heavy load acts on the blade, which is used in combination with the brush, and accelerates the deterioration of the blade, thereby rendering cleaning defective. In addition, maintenance cost increases due to frequent replacement of the cleaning member.

The blade of the cleaning device may be configured to remove the residues by grinding the surface of the photoconductive element, as also proposed in the past. In this connection, a method of feeding an abrasive for grinding has also been proposed. However, when the surface of the photoconductive element is ground, it is likely that the abrasive and part of a photoconductive layer shaved off are introduced in a developer. This not only lowers image quality, bur varies chargeability due to the variation of the thickness of the photoconductive layer and scratches the surface of the photoconductive layer.

In light of the above, the blade or similar stationary cleaning member may be replaced with a rubber roller or similar elastic member movable by following the movement of the surface of the photoconductive element. This, however, brings about another problem that when the photoconductive element is in a halt, the residues between the photoconductive element and the rubber roller remain pressed against the photoconductive element and are therefore positively deposited on the photoconductive element.

The amount by which the surface of the photoconductive element is ground may be reduced if frictional resistance between the above surface and the cleaning member is reduced or if the hardness of the surface is increased. However, when frictional resistance is reduced, the cleaning member is apt to fail to remove discharge products different from the residues described above. Typical of discharge products are ozone, NOx (nitrogen oxides) and a nitric compound (ammonium nitrate) derived from a nitrogen oxide thereof. Such discharge products are produced not only when discharge is effected in a space, but also when a charge roller is held in contact with the photoconductive element. The nitric compound, which is moisture-absorptive, has high resistance in a low humidity environment, but has low resistance in a high humidity environment due to moisture absorption. When the nitric compound, among others, accumulates on the photoconductive element little by little and extends over both of an image portion and background, the charge of the background is apt to migrate toward the image portion, increasing the potential of the image portion. This obstructs the deposition of toner on the image portion and is likely to bring about the local omission of an image.

The higher the surface hardness of the photoconductive element, the higher the resistance to wear and therefore the easier the removal of the residues and discharge products by the blade. An amorphous silicon is one of substances that effectively provide the photoconductive element with a hard surface.

In Laid-Open Publication Nos. 2-140563 and 2-149969 mentioned earlier, the brush and blade are respectively positioned at the upstream side and downstream side in the direction of movement of the photoconductive element in order to reduce the amount of grinding of the photoconductive element. However, the brush used to clean the photoconductive element brings about the problems stated earlier, depending on the amount of residues collected from the photoconductive element.

SUMMARY OF THE INVENTION

It is an object of the present invention to provide a cleaning device capable of preserving expected cleaning efficiency against aging with a simple configuration, and an image forming apparatus using the same.

It is another object of the present invention to provide a cleaning device capable of protecting cleanability from deterioration when using a brush, and protecting chargeability on the surface of a photoconductive element from variation to thereby obviate an increase in cost relating to a cleaning member, and an image forming apparatus using the same.

A cleaning device for cleaning an image carrier by removing toner and other residues left thereon of the present invention includes a brush having tips, which contact the surface of the image carrier, provided with a loop configuration and a contact pressure of 50 g/cm$^2$. A toner collecting space is located at a position adjacent to the brush and at which the tips of the brush contacted the surface of the image carrier arrive in accordance with the movement of the brush.

An image forming apparatus using the above cleaning device is also disclosed.

BRIEF DESCRIPTION OF THE DRAWINGS

The above and other objects, features and advantages of the present invention will become more apparent from the following detailed description taken with the accompanying drawings in which:

FIGS. 10 and 11 are tables listing the results of experiments conducted to determine the cleaning effect achievable with the cleaning device of the alternative embodiment;

DESCRIPTION OF THE PREFERRED EMBODIMENTS

Figure 1:
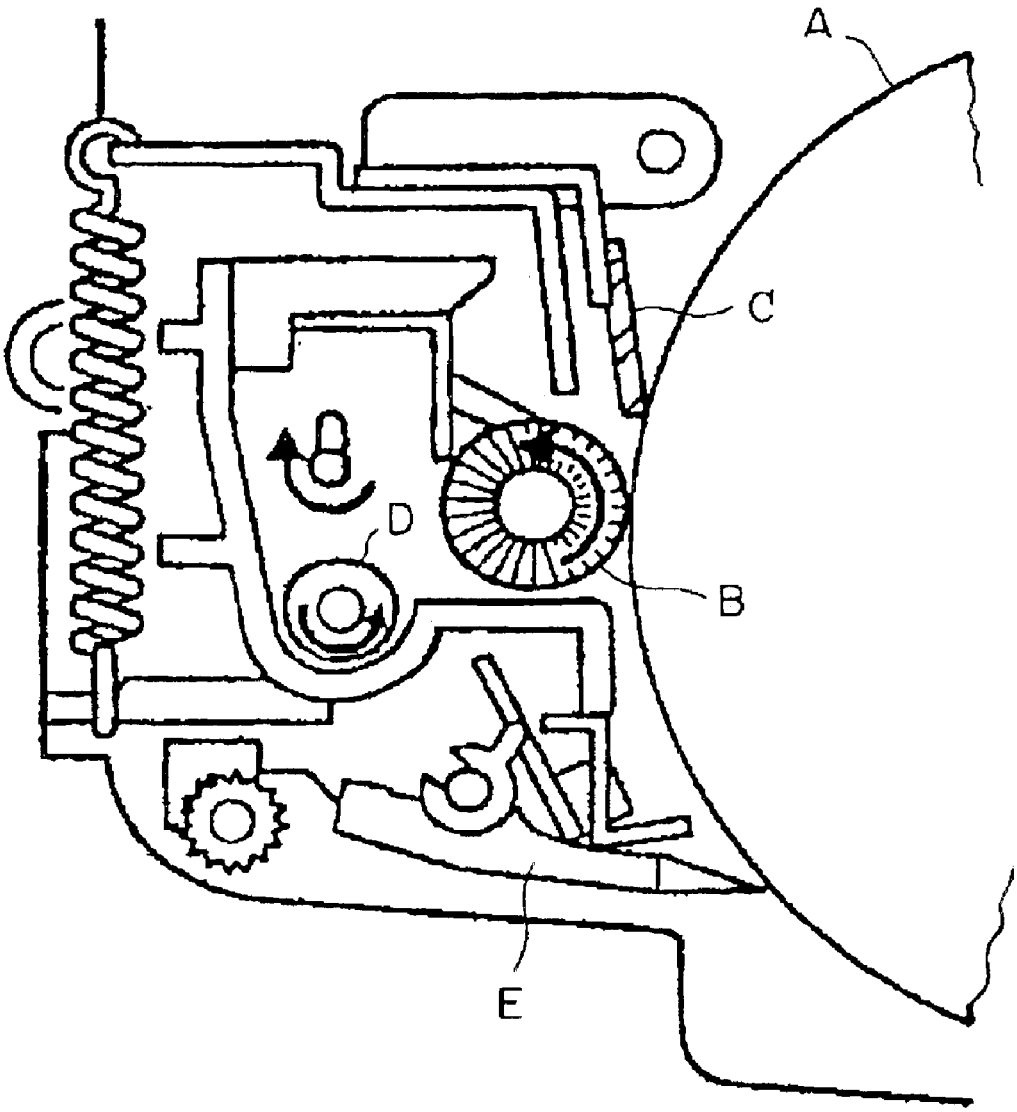
FIG. 1 PRIOR ART
FIG. 1 is a view showing a conventional cleaning device.

To better understand the present invention, brief reference will be made to a conventional cleaning device for an image forming apparatus, shown in FIG. 1. As shown, the cleaning device includes a brush B and a blade C held in contact with the circumference of a photoconductive element or image carrier A. The photoconductive element A is implemented as a drum. A coil D is positioned behind the brush B in order to convey collected toner for a recycling purpose. Labeled E in FIG. 1 is a peeler for peeling off a sheet or recording medium from the drum A. The problem with the brush B is that it has looped tips and therefore brings about defective cleaning, as discussed earlier.

Figure 2:
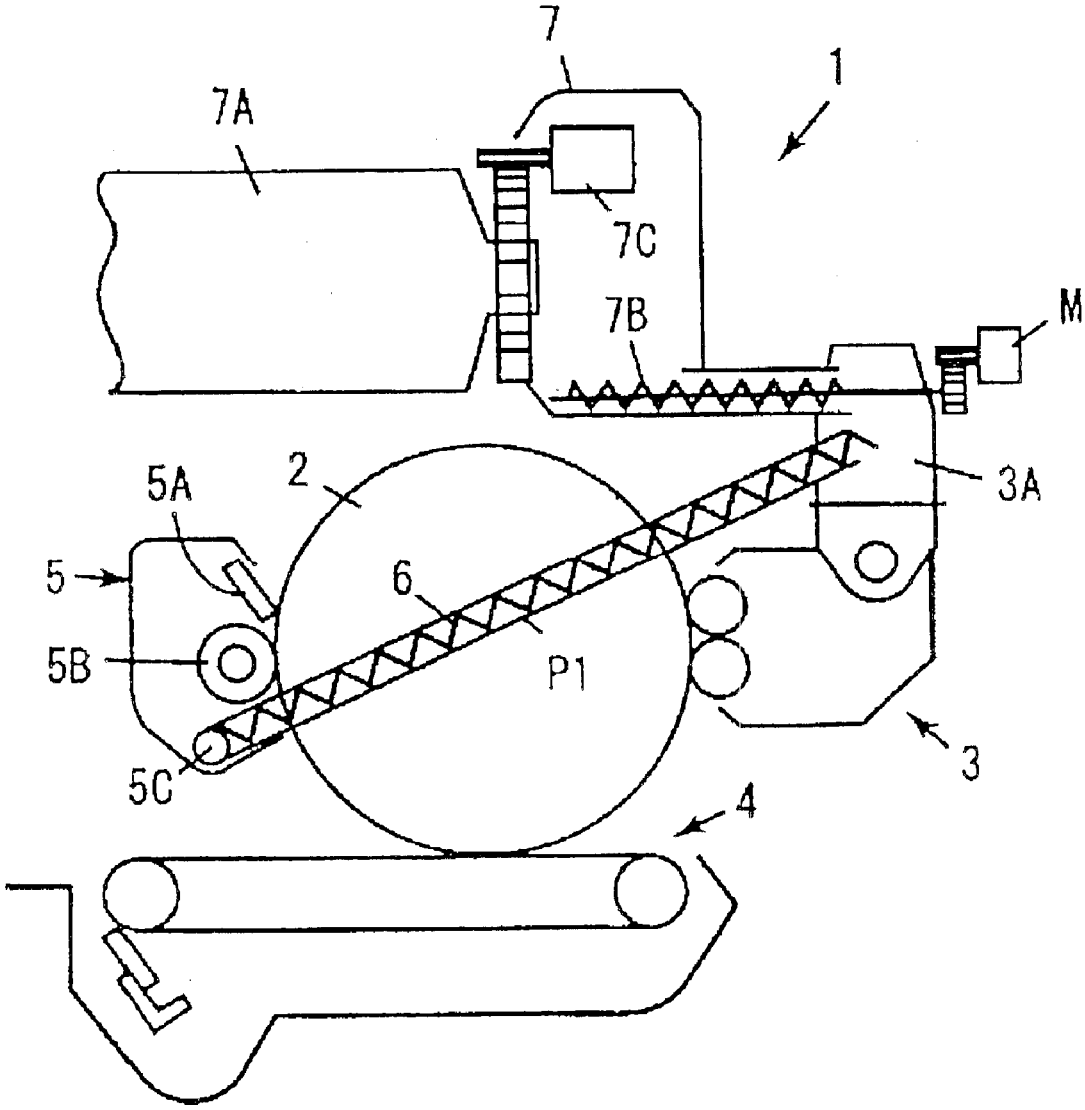
FIG. 2 is a view showing an image forming apparatus embodying the present invention.

Referring to FIG. 2, an image forming apparatus including a cleaning device embodying the present invention is shown. While the image forming apparatus is implemented as a copier in FIG. 2, the illustrative embodiment is applicable to any other image forming apparatus, e.g., a printer or a facsimile apparatus. As shown, the image forming apparatus, generally 1, includes a photoconductive drum or image carrier 2. Arranged around the drum 2 are a charger, not shown, an optical writing unit, not shown, a developing device 3, an image transferring device 4, and a cleaning device 5. These units and devices execute an image forming process while the drum 2 is in rotation.

More specifically, the developing device 3 develops a latent image formed on the drum 2 by the writing unit with toner, thereby producing a corresponding toner image. The image transferring device 4 transfers the toner image from the drum 2 to a sheet or recording medium fed from a sheet feeding device not shown. The sheet carrying the toner image thereon is conveyed to a fixing device, not shown, and has the toner image fixed thereby.

After the image transfer stated above, the cleaning device 5 scrapes off the toner left on the drum 2 with a blade 5A and a brush 5B. A screw 5C is also disposed in the cleaning device 5. A recycle path P provides communication between one end of the screw 5C in the lengthwise direction and a toner feeding section 3A, which forms part of the developing device 3. A screw 6 is arranged on the path P1 for returning the toner scraped off by the blade 5A and brush 5B to the developing device 3.

In the developing device 3, a screw 7B is driven by a motor M to convey fresh toner from a toner bottle 7A, which is mounted to a toner replenishing section 7, to the toner feeding section 3A. The fresh toner thus replenished and recycled toner are mixed together in the developing device 3 and used to develop a latent image, as stated above. The toner bottle 7A is formed with a spiral groove in its circumferential wall although not shown specifically. When the toner bottle 7A with such a configuration is rotated by a drive source 7C, fresh toner stored in the toner bottle 7A is moved in the axial direction of the bottle 7A and then discharged toward the screw 7B.

Figure 3:
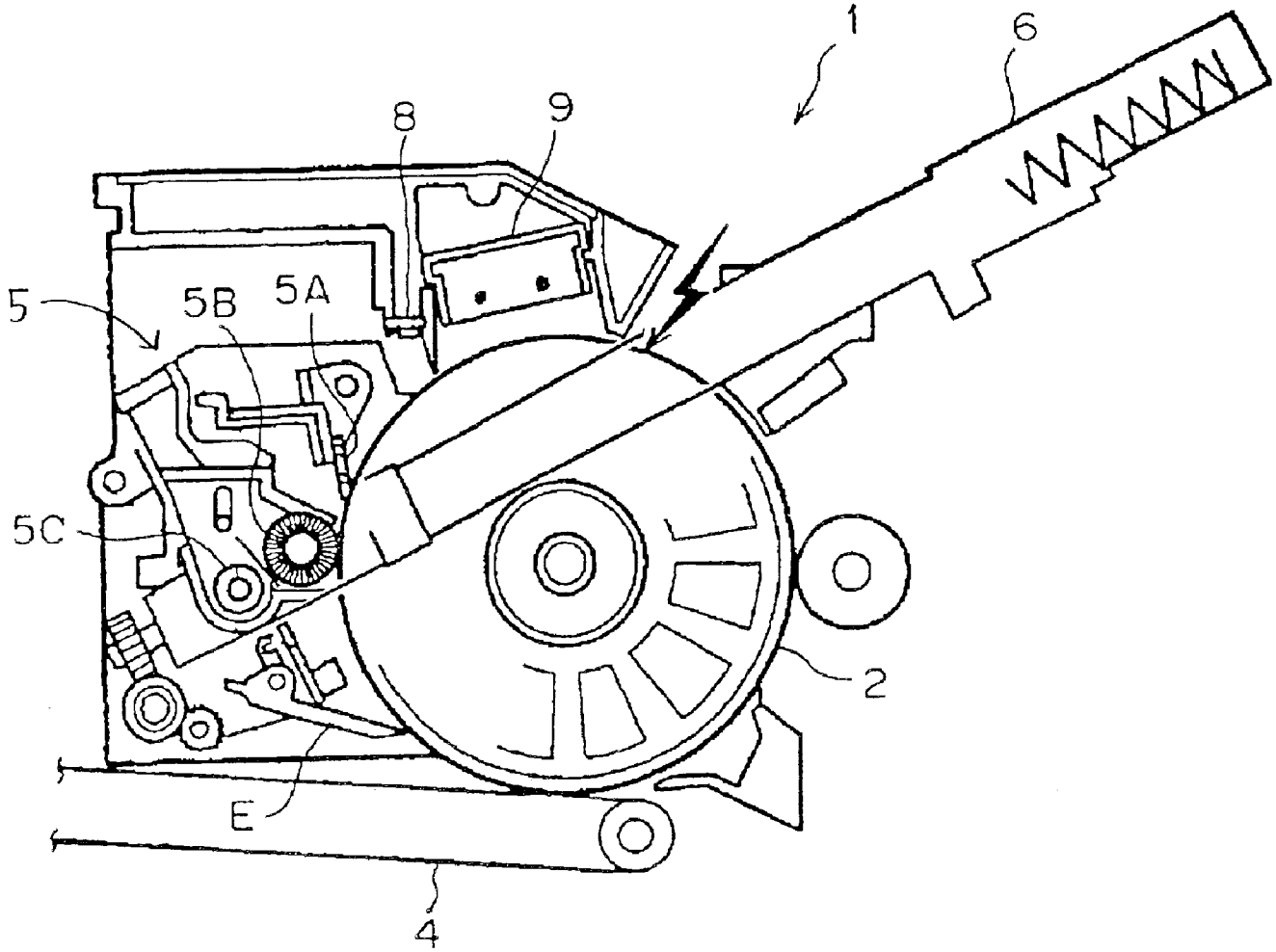
FIG. 3 is a view showing arrangements around a cleaning device included in the illustrative embodiment.

FIG. 3 shows the cleaning device 5 in detail. In FIG. 3, the reference numerals 8 and 9 respectively designate a quenching lamp and a charger, which are not shown in FIG. 2. Also, labeled E is a peeler having the function stated earlier in relation to the conventional cleaning device.

Figure 4:
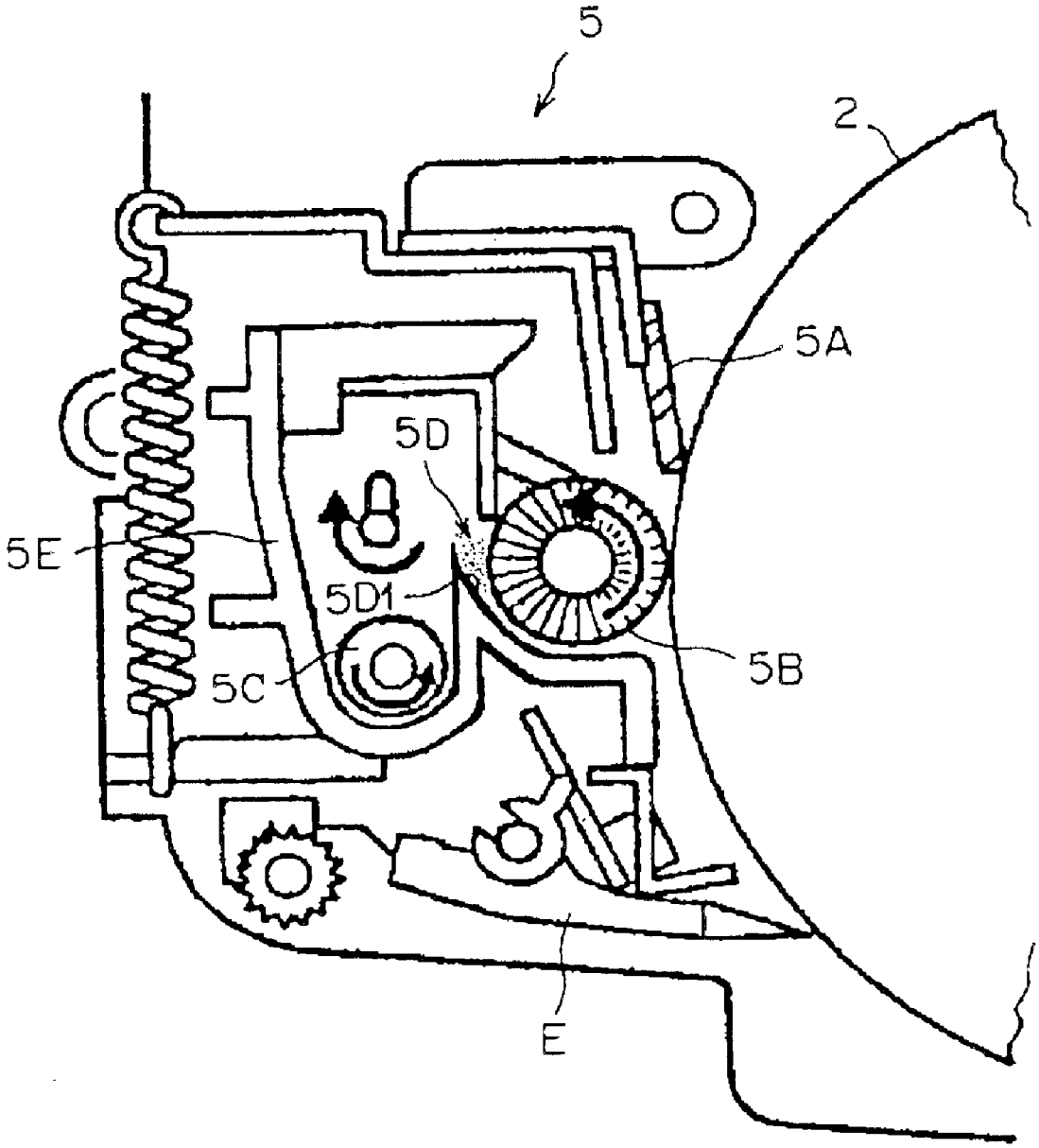
FIG. 4 is a view showing the cleaning device of the illustrative embodiment more specifically.

FIG. 4 shows the cleaning device 5 in more detail. In the illustrative embodiment, the brush 5B has looped tips although not shown specifically and is held in contact with the drum 2 under pressure of 50 g/cm$^2$ or above. The brush 5B is rotatable in a direction indicated by an arrow in FIG. 4, which is opposite to the direction of rotation of the drum 2.

In the cleaning device 5, a toner collecting space 5D is formed at a position at which the tips of the brush 5B contacted the drum 2 arrive in accordance with the rotation of the brush 5B. The toner collecting space 5D is formed by part of a unit 5E accommodating the brush 5B and coil 5C and faces the drum 2 with the intermediary of the brush 5B.

The toner collecting space 5D includes a slant 5D1 underlying the brush 5B. The slant 5D1 is inclined such that an upper portion is spaced from the tips of the brush 5B more than a lower portion. The slant 5D1 therefore provides the toner collecting space 5D with a wedge-like shape narrowed at a position just preceding a position where the tips of the brush 5B face the drum 2.

In operation, when the brush 5B is rotated, the tips of the brush 5B collect toner left on the drum 2 and convey it to the toner collecting space 5D. As a result, the toner dropped from the brush 5B is collected in the toner collecting space 5D. The tips of the brush 5B pass through the toner collecting space 5D while the brush 5B is in rotation, and can therefore contact the toner collected in the space 5D. Consequently, part of the toner present in the toner collecting space 5D can deposit on the tips of the brush 5B.

Assume that a certain amount of toner is deposited on the tips of the brush 5B. Then, when an image with a small area ratio is repeatedly formed, the amount of toner collected by the brush 5B decreases little by little with the result that the tips of the brush 5B easily contact the drum 2. By contrast, in the illustrative embodiment, a certain amount of toner is constantly deposited on the tips of the brush 5B, reducing the probability that the tips of the brush 5B directly contact the drum 2. This successfully reduces triboelectrification and therefore an irregular potential distribution on the drum 2 ascribable to the direct contact of the tips of the brush 5B with the drum 2, thereby obviating defective images. Further, the frictional charge to deposit on the drum 2 increases little, so that restraint on the toner is reduced. Consequently, the expected scraping effect of the blade 5A is insured, obviating defective cleaning.

Moreover, the wedge-shaped toner collecting space 5D allows the toner to easily deposit on the tips of the brush 5B as the brush 5B in rotation approaches the drum 2. The toner on the brush 5B is therefore prevented from becoming short.

Figure 5:
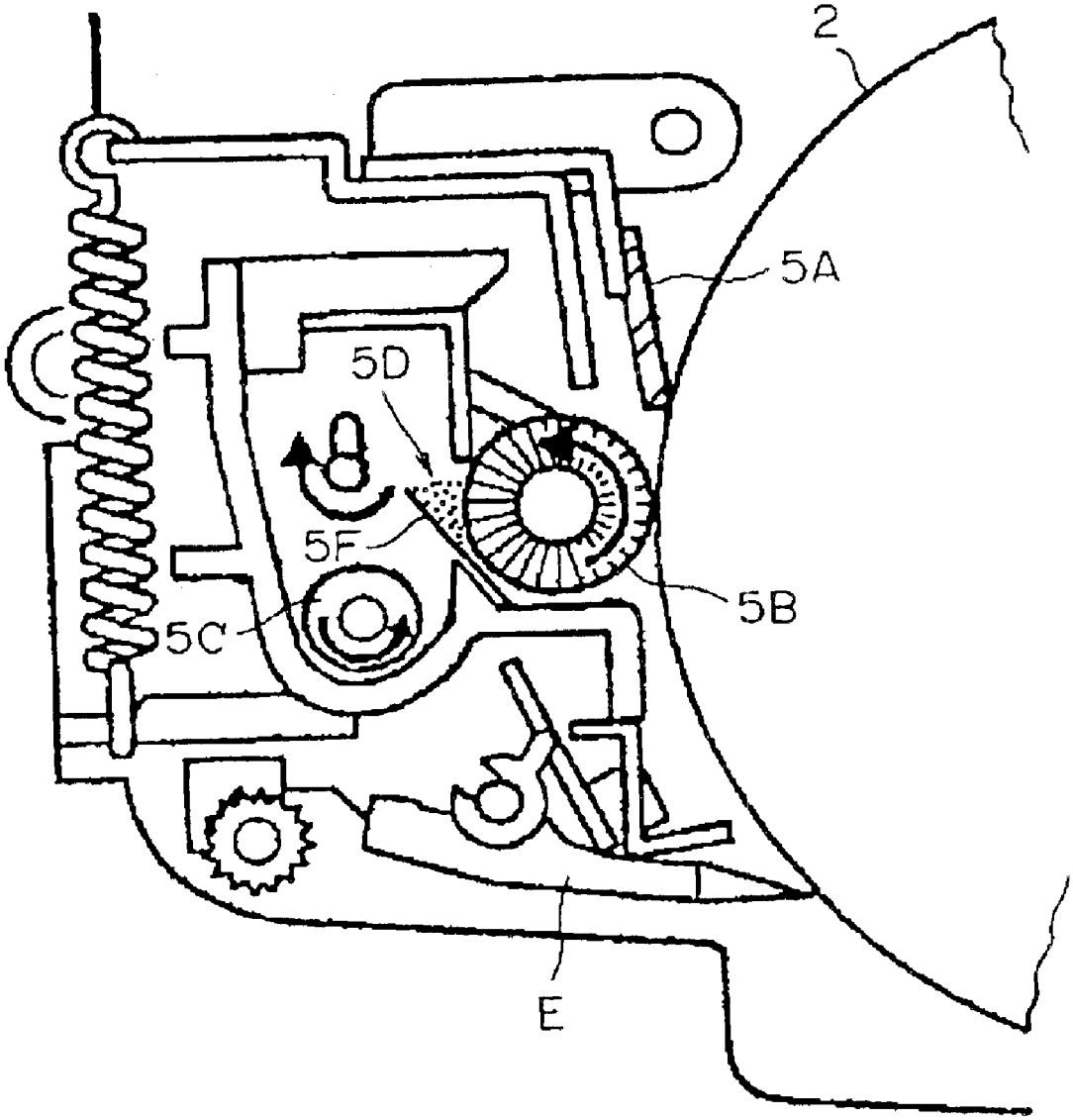
FIG. 5 is a view showing a modification of the illustrative embodiment.

Reference will be made to FIG. 5 for describing a modification of the illustrative embodiment. As shown, the modification differs from the illustrative embodiment in that the toner collecting space 5D includes an elastic sheet 5F forming the slant 5D1, FIG. 4. The elastic sheet 5F is affixed to part of the unit 5E and configured in the same manner as the slant 5D1.

When the amount of toner collected in the toner collecting space 5D, as stated earlier, increases, the toner coheres and raises pressure inside the space 5D. In the modification, the elastic sheet 5F resonates due to vibration ascribable to the rotation of the brush 5B, loosening the toner cohered in the toner collecting space 5D. Therefore, the toner in the toner collecting space 5D does not loose fluidity and can positively, constantly deposit on the tips of the brush 5B in a certain amount, also preventing triboelectrification from increasing on the drum 2.

As stated above, the illustrative embodiment and modification thereof have various unprecedented advantages, as enumerated below.

(1) Toner and other residues removed from the drum or image carrier 2 can be collected in the toner collecting space 5D in an amount large enough to deposit on the tips of the brush 5B and can therefore constantly remain on the tips in a certain amount. It follows that even when the amount of toner collected from the drum 2 is small, the probability that the tips of the brush 5B directly contact the drum 2 is reduced. As a result, an increase in triboelectrification on the drum 2 and therefore a decrease in cleaning efficiency is obviated.

(2) Even when the amount of toner collected in the toner collecting space 5D increases and raises pressure inside the space 5D due to the cohesion of toner, vibration derived from the rotation of the brush 5B successfully loosens the cohered toner for thereby promoting the deposition of the toner on the brush 5B. This also achieves the above advantage (1).

(3) The wedge-shaped toner collecting space 5D allows the brush 5B, which rotates in the opposite direction to the drum 2, to easily take in the toner existing in the space 5D by a sufficient amount. This also achieves the advantage (1).

(4) The amount of charge to deposit on the drum 2 due to triboelectrification is prevented from increasing, so that defective images ascribable to an irregular potential distribution on the drum 2 are obviated.

An alternative embodiment of the present invention will be described with reference to FIG. 6. The alternative embodiment is implemented as a printer although it may, of course, be implemented as a copier or a facsimile apparatus by way of example. As shown, the printer, generally 1A, includes a photoconductive drum or image carrier 20. Arranged around the drum 20 are a charger 30, an optical writing unit represented by an optical path 40, a developing device 50, an image transferring device 60, and a cleaning device 70.

In operation, the charger 30 uniformly charges the surface of the drum 20 being rotated. The optical writing unit 40 scans the surface of the drum 20 thus charged in accordance with image data to thereby form a latent image. The developing device 50 develops the latent image with toner for thereby producing a corresponding toner image. The image transferring device 60 transfers the toner image from the drum 20 to a sheet fed from a sheet feeding section not shown. Subsequently, a fixing device, not shown, fixes the toner image on the sheet.

In the illustrative embodiment, the drum 20 may be implemented as an amorphous silicon, photoconductive element (a-Si element hereinafter). To produce an a-Si element, after a conductive support has been heated to 50° C. to 400° C., a photoconductive layer implemented by a-Si is formed on the support by any one of vacuum evaporation coating, sputtering, ion plating, thermal CVD (Chemical Vapor Deposition), optical CVD, plasma CVD and other conventional film forming technologies. Among them, plasma CVD is desirable because it decomposes a material gas with DC, high-frequency wave or microwave glow discharge for thereby forming an a-Si layer.

FIGS. 7A, 7B, 7C and 7D respectively show a-Si photoconductive elements 20A, 20B, 20C and 20D each having a particular structure. As shown, the element 20A is made up of a support 20A-1 and a photoconductive layer 20A-2 formed of a-Si:H,X. The element 20B is made up of a support 20B-1, a photoconductive layer 20B-2 formed of a-Si:H,X, and an a-Si surface layer 20B-3. The element 20C is made up of a support 20C-1, a photoconductive layer 20C-2 formed of a-Si:H,X, an a-Si surface layer 20C-3, and an a-Si charge injection blocking layer 20C-4. Further, the element 20D is made up of a support 20D-1, a photoconductive layer 20D-2, and an a-Si surface layer 20D-5. The photoconductive layer 20D-2 consists of an a-Si:H,X charge generation layer 20D-3 and a charge transport layer 20D-4.

In anyone of the structures shown in FIGS. 7A through 7D, the support may be either conductive or insulative, as desired. A conductive substance for the support may be selected from a group of metals including Al, Cr. Mo, Au, In, Nb, Te, V, Ti, Pt, Pd and Fe and alloys thereof including stainless steel. Alternatively, a film or a sheet of polyester, polyethylene, polycarbonate, cellulose acetate, polypropylene, polyvinyl chloride, polystyrene, polyamide or similar synthetic resin or glass, ceramics or similar insulative support may have at least one surface thereof expected to form a photoconductive layer thereon processed for electric conduction.

The support may be implemented as either one of a drum having a smooth or an irregular surface and an endless belt. While the thickness of the support may be suitably selected in accordance with the desired element configuration, it should preferably be as small as possible within an allowable range when the element is required to have flexibility. Usually, the thickness is selected to be 10 μm or above from the production, handling and mechanical strength standpoint.

The charge injection blocking layer is interposed between the conductive support and the photoconductive layer in order to effectively prevent charge from being injected from the support into the photoconductive layer. More specifically, when the free surface of the photoconductive layer is subject to charging of one polarity, the charge injection blocking layer prevents charge from being injected from the support into the photoconductive layer. The charge injection blocking layer does not exhibit such a function when charging applied to the free surface of the photoconductive layer is of the other polarity. In this manner, the charge injection blocking layer is polarity-dependent. For this purpose, the charge injection blocking layer contains a larger number of atoms, which control conductivity, than the photoconductive layer. The thickness of the charge injection blocking layer should preferably be between 0.3 μm and 4 μm, optimally between 0.5 μm and 3 μm, which implements desired electrophotographic characteristics and promotes cost reduction.

The photoconductive layer, which may be formed on an under layer, should preferably be 1 μm thick to 100 μm thick, more preferably 20 μm thick to 50 μm thick or optimally 23 μm thick to 45 μm thick, also from the standpoint mentioned above.

The charge transport layer functions mainly to transport charges when the photoconductive layer is divided in function. The charge transport layer contains at least silicon atoms, carbon atoms and fluorine atoms and may, if necessary, be formed of a-SiC (H, F, O) containing hydrogen atoms and oxygen atoms. The charge transport layer has desired photoconductive characteristics, particularly, charge holding characteristic, charge generating characteristic and charge transporting characteristic. Particularly, in the illustrative embodiment, the charge transport layer should preferably contain oxygen atoms. The thickness of the charge transport layer should preferably be between 5 μm and 50 μm, more preferably between 10 μm and 40 μm or optimally between 20 μm and 30 μm, which implement desired electrophotographic characteristics and promote cost reduction.

The charge generation layer functions mainly to generate charges when the photoconductive layer is divided in function. The charge generation layer is formed of a-Si:H containing at least silicon atoms, but containing substantially no carbon atoms, and containing, if necessary, hydrogen atoms and has desired photoconductive characteristics, particularly charge generating characteristic and charge transporting characteristic. The thickness of the charge generation layer should preferably be between 0.5 μm and 15 μm, more preferably between 1 μm and 10 μm or optimally between 1 μm and 5 μm, which implement desired electrophotographic characteristics and promote cost reduction.

In the a-Si element of the illustrative embodiment, the surface layer should preferably be an a-Si surface layer formed on the photoconductive layer formed on the support, as stated earlier. Having a free surface, the surface layer is used to satisfy preselected conditions as to moisture resistance, resistance to repeated use, voltage resistance, resistance to environment, and durability. In the illustrative embodiment, the surface layer should be 0.01 μm thick to 3 μm thick, preferably 0.05 μm thick to 2 μm thick or optimally 0.1 μm thick to 1 μm thick. Thickness below 0.01 μm would cause the surface layer to be lost due to, e.g., wear while thickness above 3 μm would increase residual potential or otherwise degrade electrophotographic characteristics.

Figure 8:
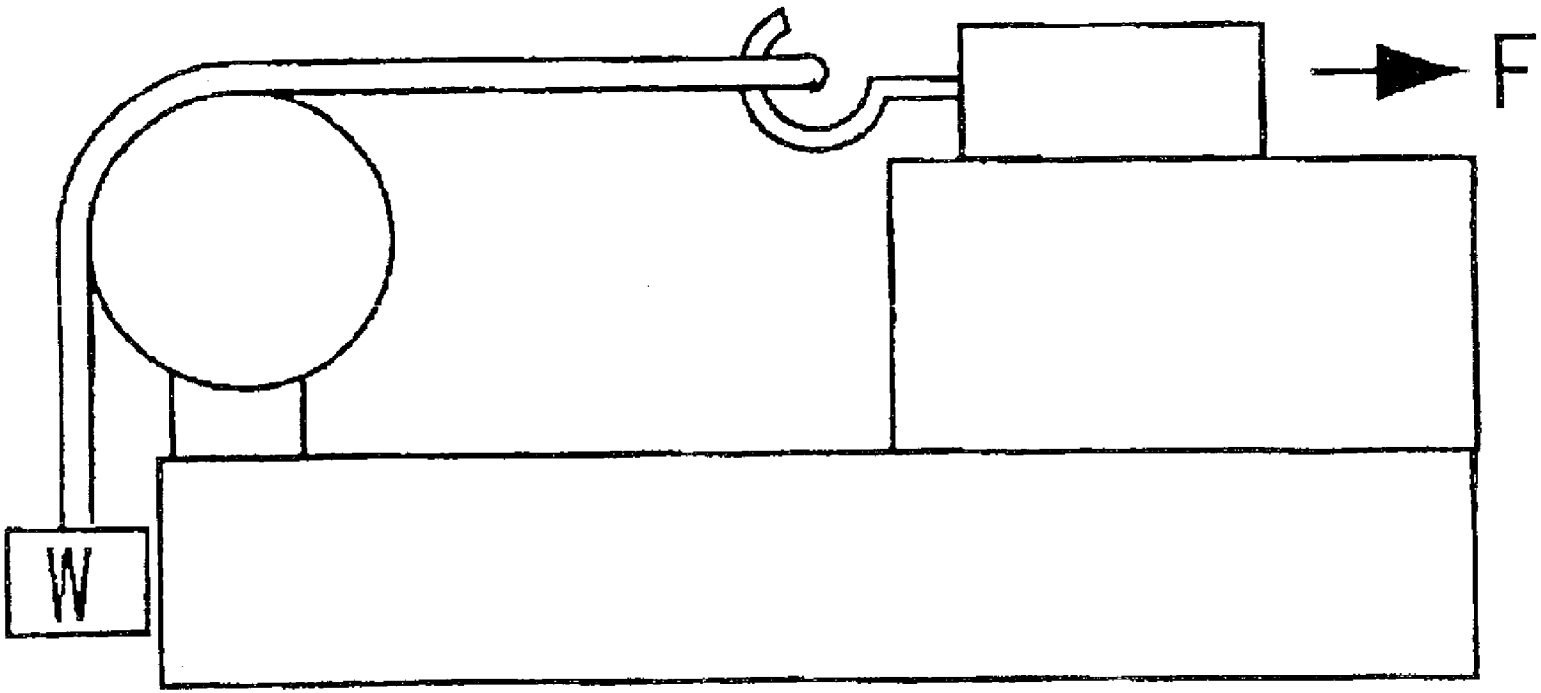
FIG. 8 is a view showing a specific arrangement for measuring a coefficient of friction on the surface of a photoconductive element.

A coefficient of friction $\mu$ on the surface of the drum 20 is selected to be 0.2 or above so as to reduce frictional resistance between the drum 20 and a brush 18 and a blade 19, which are included in the cleaning device 70. FIG. 8 shows a specific system for measuring a coefficient of friction on the drum 20, which is generally referred to as an Euler belt system prescribed by JSME (The Japan Society of Mechanical Engineers). In accordance with the Euler belt system, a weight (W) of 100 g is used in order to determine a coefficient of friction u expressed as:

$$\mu=\ln(F/100)/(\pi/2))$$

After the image transfer, the toner and other residues left on the drum 20 are removed by the cleaning device 70 while, at the same time, residual charges are also removed. Subsequently, the charger 30 again uniformly charges the surface of the drum 20 for thereby preparing it for the next image forming cycle.

The brush 18 and blade 19 of the cleaning device 70 are respectively positioned at the upstream side and downstream side in the direction of rotation of the drum 20 within a unit 70A, which is formed with an opening that faces the drum 20. The blade 19 is formed of urethane. Also disposed in the unit 70A are a coil 11, a seal 12, and a vent portion 70B. The coil 11 conveys the toner collected from the drum 20 to a conduit 10 as recycled toner. The seal 12 seals the upstream inlet of the unit 70A in the direction of rotation of the drum 20. The vent portion 70B releases pressure inside the unit 70A to the outside. In FIG. 6, the reference numeral 13 designates a toner content sensor responsive to the toner content of a developer.

Figure 9A:
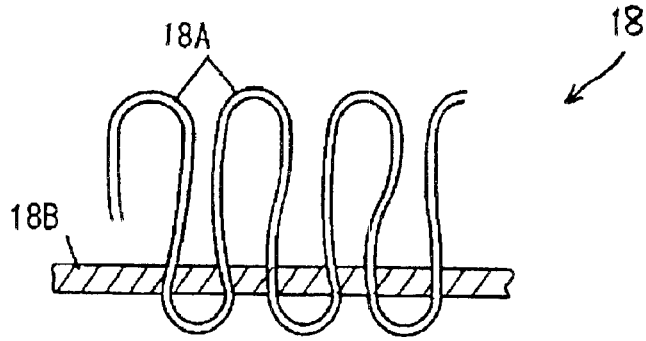
FIGS. 9A through 9D are views showing a specific configuration of a brush included in the cleaning device of the alternative embodiment.
Figure 9B:
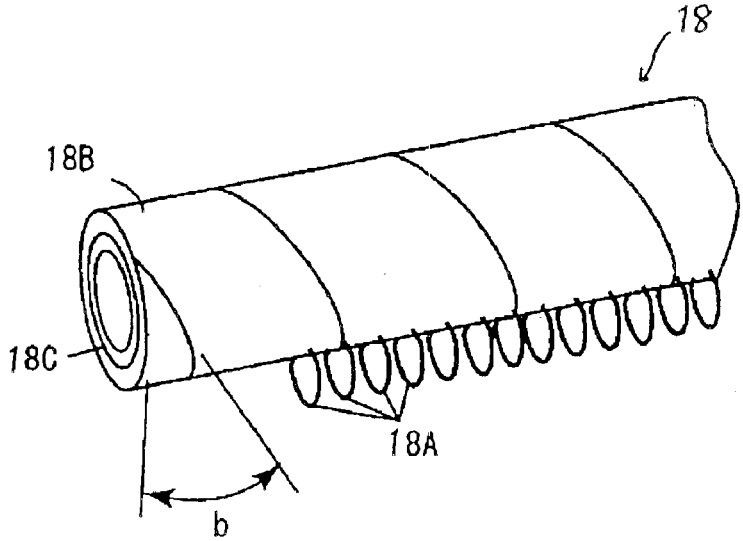

In the illustrative embodiment, the brush 18 of the cleaning device 70 is implemented as a fur brush implanted in the surface of a rotatable roller. More specifically, as shown in FIGS. 9A through 9D, the brush 18 is rotated in such a direction that a fur brush 18A moves in the opposite direction to the drum 20, as viewed at a position where the brush 18 contacts the drum 20. As shown in FIG. 9A, the fur brush 18A is made up of a base cloth 18B in which loop-shaped filaments are implanted. As shown in FIG. 9B, the base cloth 18B is wrapped around a core 18C also included in the brush 18.

Figure 9C:
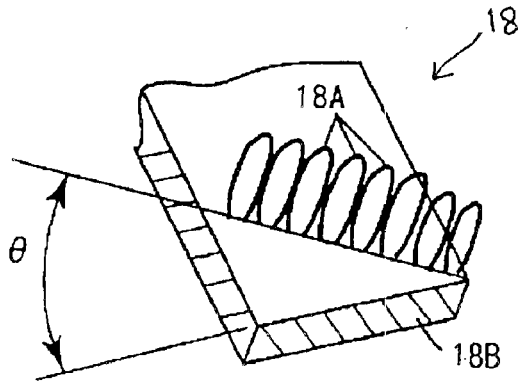
Figure 9D:
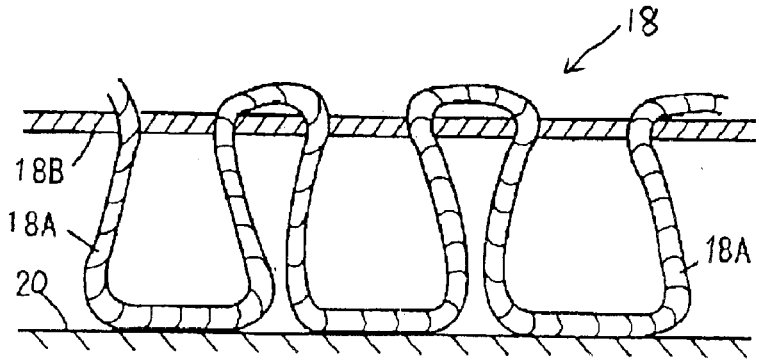

As shown in FIGS. 9A through 9C, in the illustrative embodiment, the fur brush 18A is implanted in accordance with the angle θ at which the base cloth 18B is wrapped around the core 18C. Further, the fur brush 18A is implanted in particular density that can block toner and other residues removed from the drum 20.

More specifically, in the illustrative embodiment, the filaments of the fur brush 18A are implanted in density of between 50 loops/inch$^2$ and 300 loops/inch$^2$ or above. Also, the diameter of each filament and the length or loop length of the same, as measured from the base cloth 18B, are selected such that the tip of the filament contacts the drum 20 with pressure of 50 g/cm$^2$ or above.

In the above configuration, the fur brush 18A moves in line-to-line contact with the surface of the drum 20 and therefore scratches the surface of the drum 20 less than a fur brush having pile-like tips. Further, the pressure mentioned above allows the fur brush 18A to remove not only toner and paper dust, but also additives smaller in grain size than them, left on the drum 20. Moreover, the fur brush 18A, positioned upstream of the blade 19 in the direction of the drum 20, can receive toner scraped off, but dropped from, the blade 19 and convey it away from the surface of the drum 20.

We examined the cleaning effect achievable with the brush 18 by varying its mechanical properties, e.g., diameter, loop length and density. FIG. 10 shows the results of experiments in which diameter was varied between 250 d/25F and 200 d/15F, loop length was varied between 2 mm and 4.5 mm, and density was varied between 50 loops/inch$^2$ and 45 loops/inch$^2$. Measurement was conducted with contact pressure of 21 g/cm$^2$ between the blade 19 and the drum 20 in a low temperature, low humidity environment of 10° C. and 15% RH. It was found that when the moving speed of the brush 18A was 0.5 time to 1.6 times as high as the moving speed of the drum 20, hardly any residue was found on the drum 20, i.e., a desirable cleaning effect was achieved. It is to be noted that contact pressure between the blade 19 and the drum 20 may be higher than the above particular pressure so long as, in a high temperature, high humidity environment, the edge of the blade 19 does not turn up by being drawn by the drum 20.

We further conducted a series of experiments to determine the cleaning effect by varying the coefficient of friction $\mu$ of the drum 20. FIG. 11 shows the results of experiments.

The experimental results listed in FIGS. 10 and 11 were obtained when 300,000 prints were output.

A modification of the illustrative embodiment will be described hereinafter that reduces the probability of direct contact of the tips of the fur brush 18A with the drum 20A and therefore the triboelectrification of the drum 20. In the illustrative embodiment described above, the cleaning device 70 removes toner, paper dust and additives left on the image portion of the drum 20. By contrast, in the modification, an image is formed in both of the image portion and non-image portion of the drum 20, so that the amount of residues collected by the cleaning device 70 is leveled. This obviates an occurrence that when the residues on the drum 20 become short, the residues collected by the brush 18 decrease little by little and cause the tips of the fur brush to directly contact the drum 20.

In the modification, the optical writing unit writes an image between the image portions of the drum 20 because optical writing can write any desired amount of image data. In the illustrative embodiment, the optical writing unit is expected to write a line image extending over the entire drum 20 in the main scanning direction with a width of 0.2 mm in the subscanning direction. The prerequisite with this scheme is that the amount of writing be not extremely small relative to the amount of residues that the cleaning device 70 removes from an image portion. The amount of writing is variable in accordance with the deposition of residues susceptible to the linear velocity, coefficient of friction, surface roughness and surface waving of the drum 20 as well as with the grain size, fluidity and amount of charge of the toner.

The modification forms an image in a non-image portion only for preventing the residue collection efficiency of the cleaning device 70 from noticeably varying between an image portion and a non-image portion. It is therefore possible to vary the amount of development of a solid image or for a unit area or to form a dotted line or to vary the distance between lines, i.e., to sequentially increase or reduce the number of lines. Any one of such schemes successfully obviates an occurrence that when the amount of toner deposited on the drum 20 is excessive, the load on the cleaning device 70 as to collection increases and rather lowers the cleaning efficiency than enhances it.

Optical writing for the above purpose maybe effected in either one of the following two conditions.

One of the two conditions is that the total image area of a preselected number of image portions formed before the charge potential is lowered is smaller than a reference area. For example, when the total number of pixels formed in an image portion is smaller than 3% of the image area, a single image may be formed before the next image is formed, i.e., between prints. Alternatively, when the mean area ratio of images formed by the past ten printing cycles is less than 3%, ten images may be formed before the next image is formed, i.e., between prints. Further, when images formed by the past ten printing cycles include one whose area ratio is less than 3%, a single image may be formed before the next is formed, i.e., between prints.

The other condition is that the amount of writing in the main scanning direction of the drum 20 is short. For example, when a pixel distribution in the main scanning direction is determined over the entire image formed, e.g., the entire sheet of size A4 and if any portion of the image is less than 3% in area ratio, a single image is formed. Alternatively, when the entire image repeated formed on ten sheets includes a portion where the pixel distribution in the main scanning direction is less than the area ratio of 3%, the same number of images as such portions (number of sheets) may be formed.

To form an image in a non-image portion, one or more of the charge potential, bias for development and bias for image transfer different from those assigned to an image portion are selected.

Figure 12:
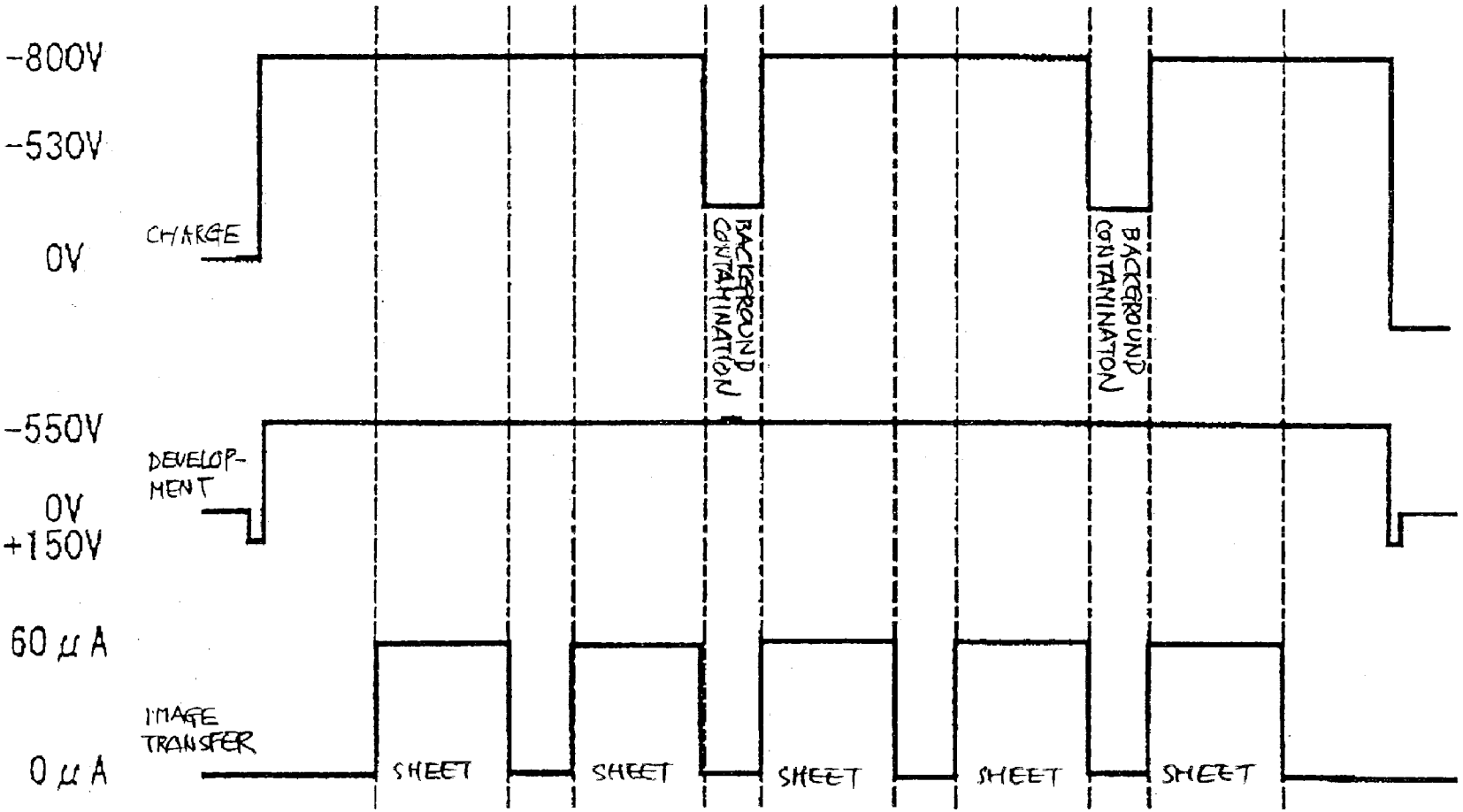
FIG. 12 is a timing chart demonstrating a specific operation of the cleaning device of the alternative embodiment.

FIG. 12 is a timing chart demonstrating a specific case wherein a charge potential different from one assigned to an image portion is assigned to a non-image portion. The prerequisite with this case is that the image transferring device 60, FIG. 6, be implemented as a corona charger or non-contact type charger while the toner be charged to negative polarity.

Timing charts are shown in FIGS. 12, 13 and 16 through 18 as if consecutive steps were executed at the time timing.

This is because the drum 20 is developed and because the consecutive steps dealing with a single sheet are arranged in the circumferential direction of the drum 20. In practice, a given point of the drum 20 sequentially moves via the consecutive steps, so that the consecutive steps are shifted from each other with respect to time (horizontal axis).

In FIG. 2, an image is formed in a non-image portion every time a preselected number of prints (two prints in FIG. 12) are output. More specifically, to form an image in a non-image portion, a potential lower than one assigned to an image portion is applied to the non-image portion. As a result, toner deposits on the non-image portion to thereby contaminate the background.

Figure 13:
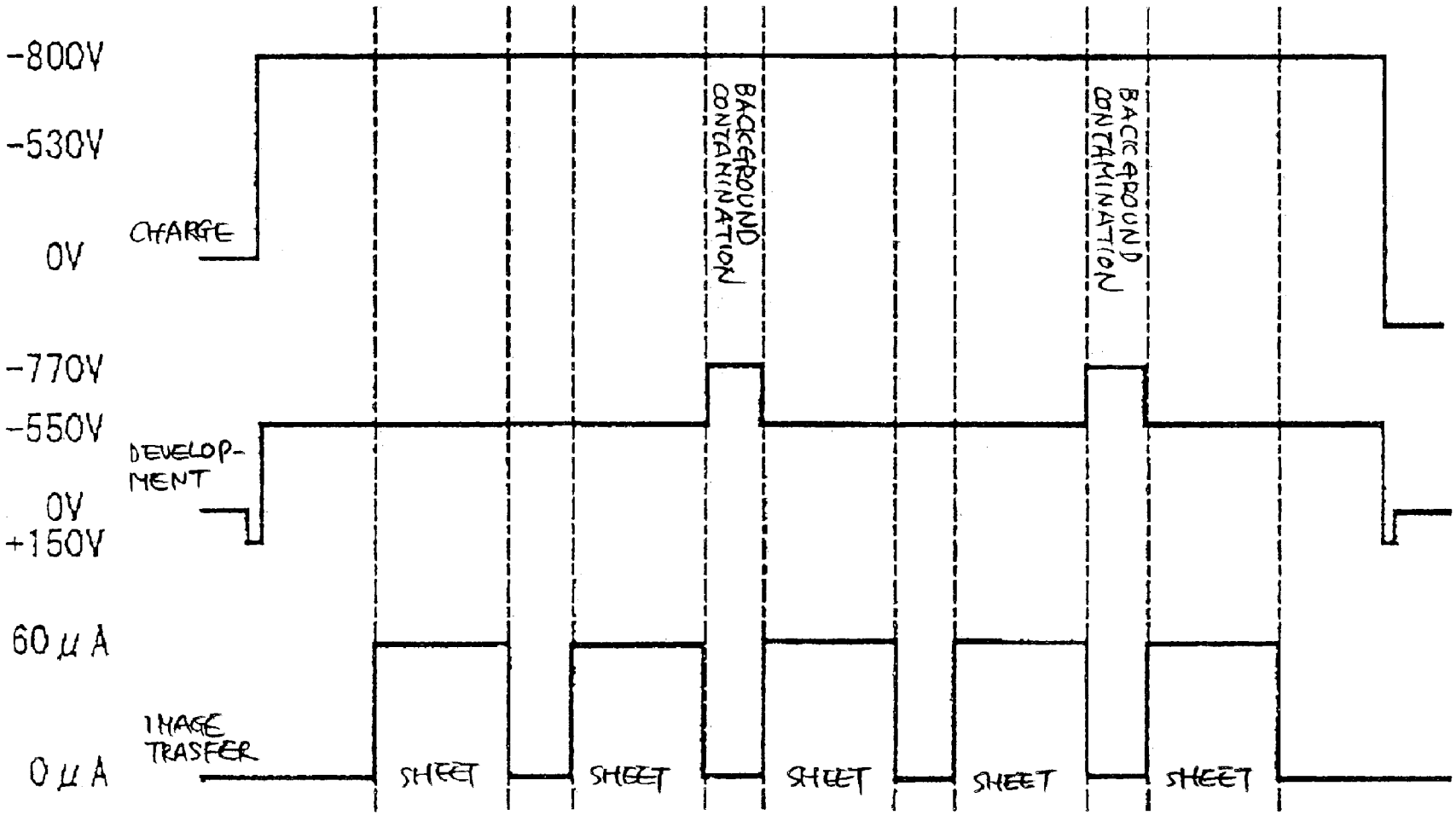
FIG. 13 is a timing chart demonstrating another specific operation of the cleaning device of the alternative embodiment.

FIG. 13 is a timing chart demonstrating another specific case wherein a bias for development is varied in place of the charge potential. As shown, a bias higher than one assigned to an image portion is assigned to a non-image portion, so that the toner fed from the developing device 50 can easily deposit on the non-image portion, i.e., contaminate the background.

Figure 6:
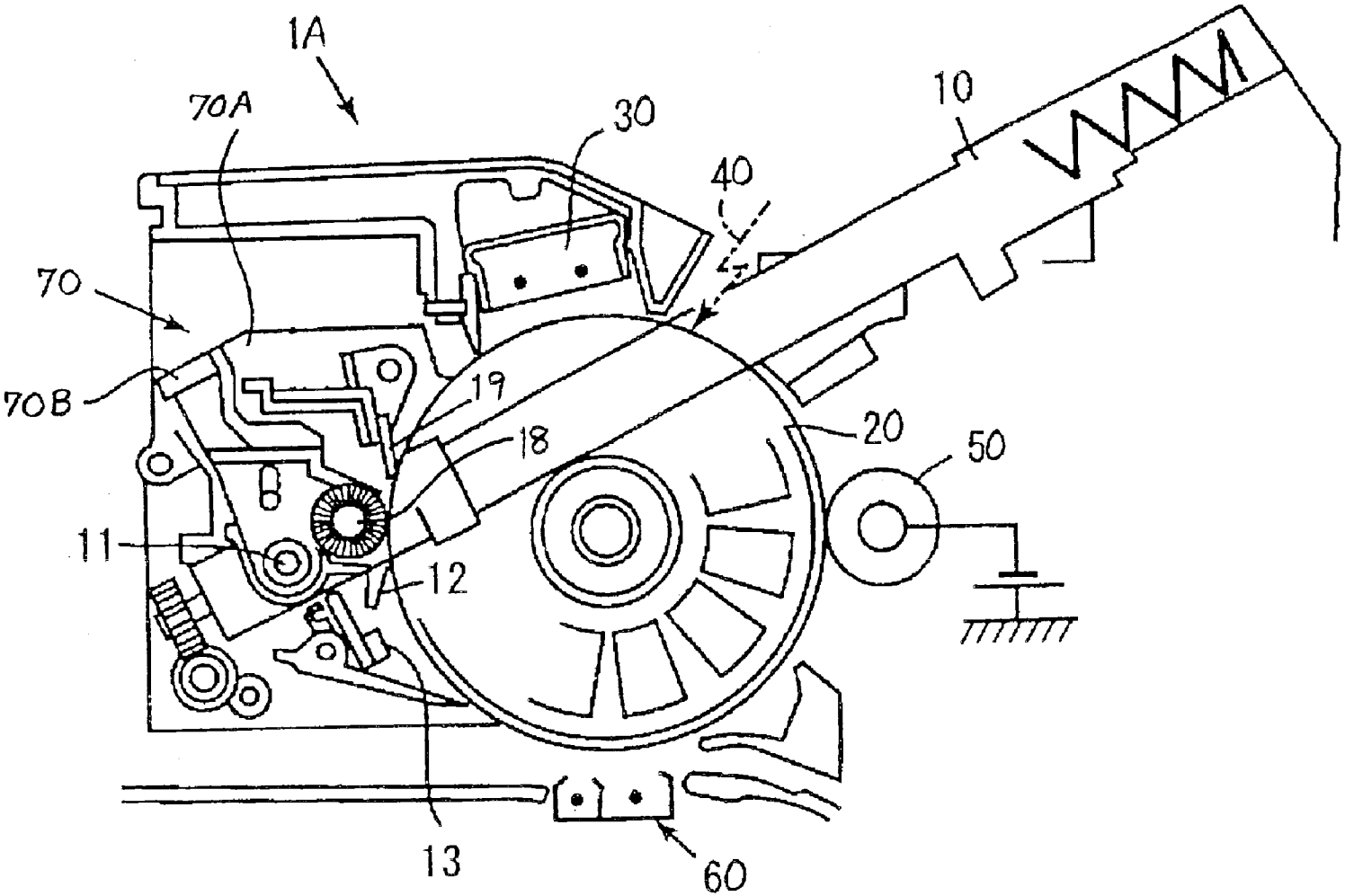
FIG. 6 is a view showing an alternative embodiment of the present invention.
Figure 7A:
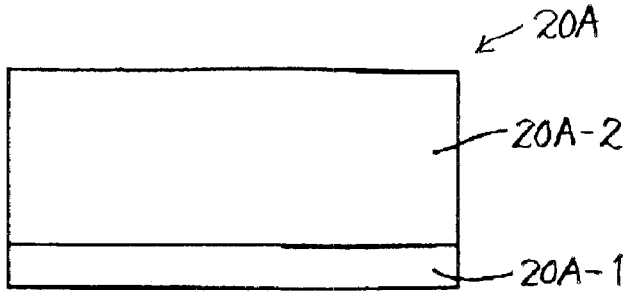
FIGS. 7A through 7D are sections each showing a particular structure of a photoconductive element to which the alternative embodiment is applicable.
Figure 7B:
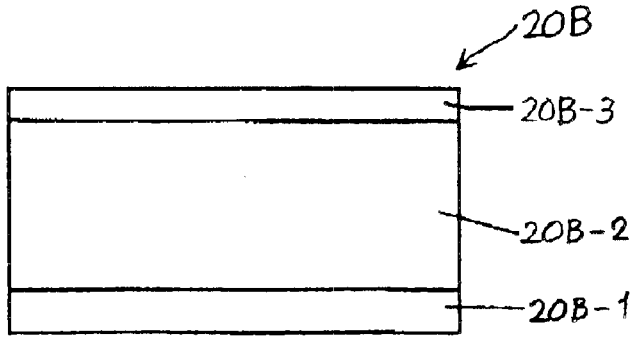
Figure 7C:
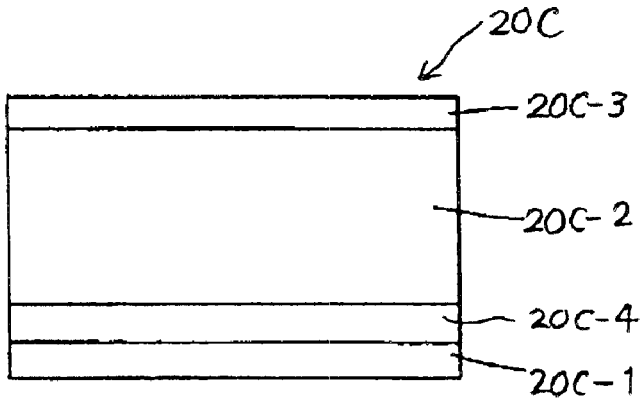
Figure 7D:
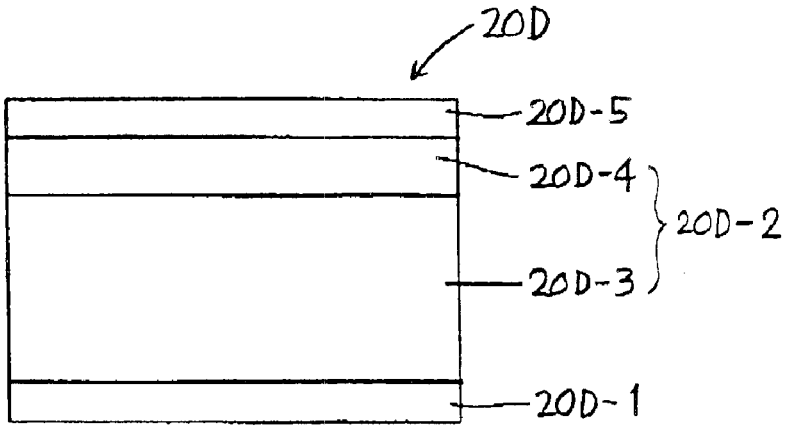

As for the timing charts shown in FIGS. 12 and 13, the image transferring device 60 of the printer 1A, FIG. 6, uses a corona charger or non-contact charger. Therefore, an image formed in a non-image portion, i.e., toner deposited on the background is conveyed to the cleaning device 70 and removed thereby in the same manner as toner left in an image portion after image transfer. It follows that the collection ratio of residues does not noticeably vary between an image portion and a non-image portion, i.e., the collection ratio of all grains in a non-image portion does not become extremely small. This successfully obviates an occurrence that the amount of residues deposited on the fur brush 18A becomes too small to prevent the tips of the brush 18A from directly contacting the drum 20.

Figure 14:
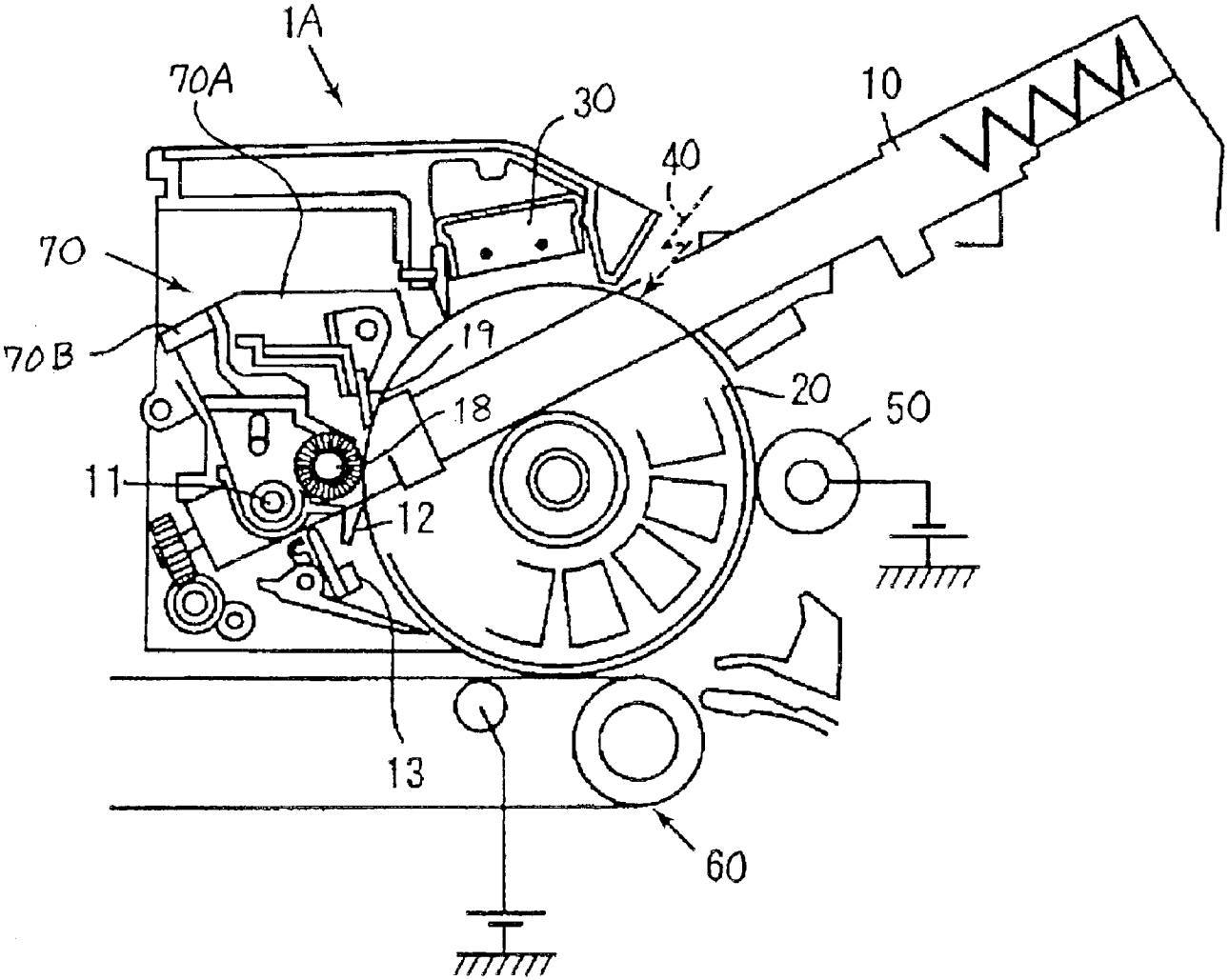
FIGS. 14 and 15 are views each showing a particular modification of the alternative embodiment.
Figure 15:
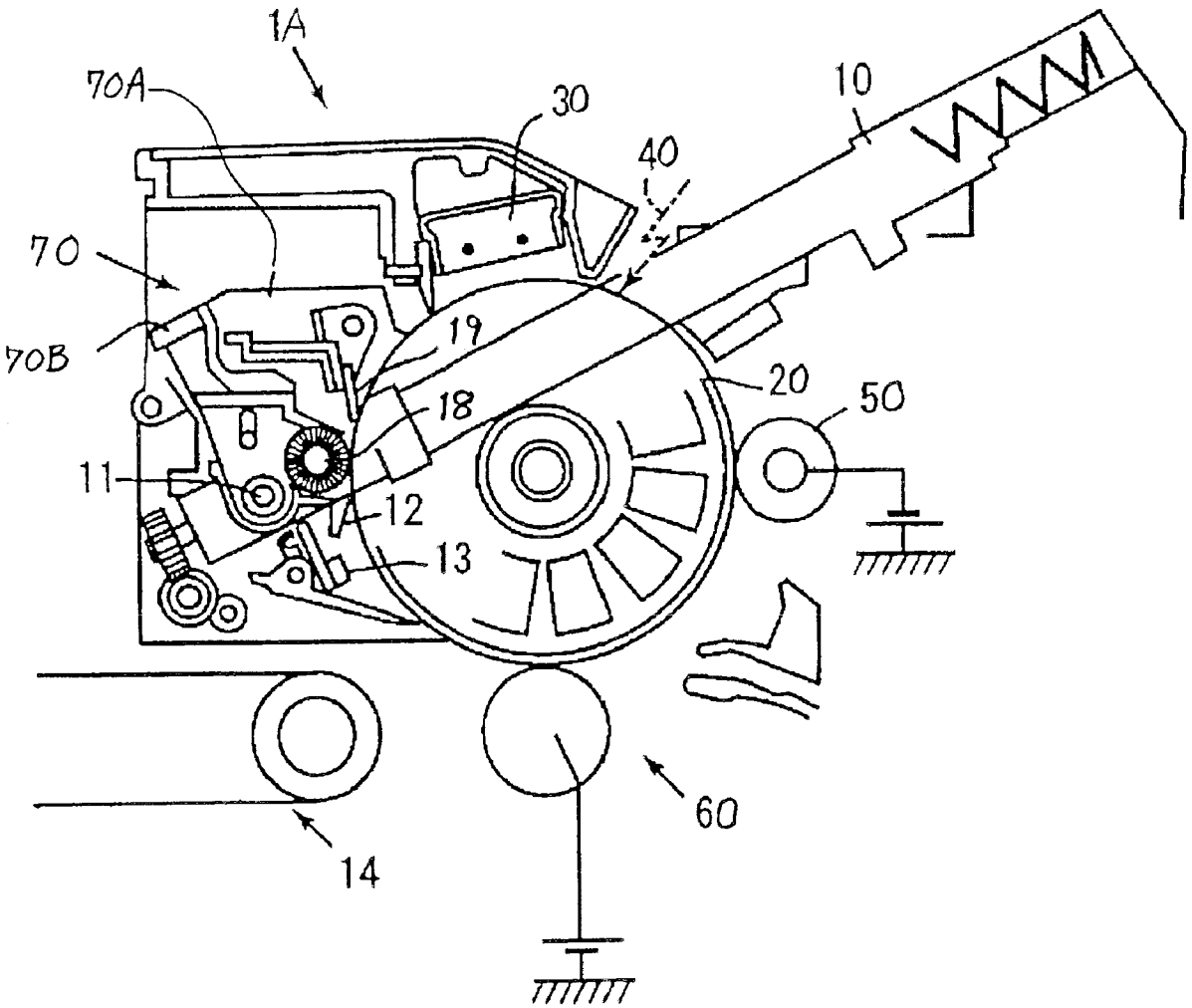

FIGS. 14 and 15 each show a particular, contact type of configuration of the image transferring device 60. As shown, a belt (FIG. 14) or a roller (FIG. 15) is held in contact with the drum 20. In FIG. 15, a sheet carrying a toner image transferred from the drum 20 by the image transferring device 60 is conveyed to a conveyor 14 implemented by a belt. The conveyor 14 conveys the sheet to the fixing device.

The problem with the contact type of image transferring device 60 stated above is that because the belt or the roller constantly contacts the drum 20, an image formed in a non-image portion is transferred to the belt or the roller. Such an image contaminates not only the belt or the roller but also the reverse side of the next sheet (offset). As a result, the amount of toner deposited in the non-image portion and therefore the amount of toner to reach the cleaning device 70 decreases, aggravating a difference in the collection ratio of residues between the non-image portion and the image portion.

To solve the above problem, the belt or the roller may be released from the drum 20 only when a non-image portion passes the image transferring device 60. However, this scheme is not practicable without resorting to an extra period of time for the repeated movement of the belt or that of the roller, extending a printing time and therefore lowering productivity. In light of this, the modification lowers a bias for image transfer for obviating the transfer of toner to the belt or the roller.

Figure 16:
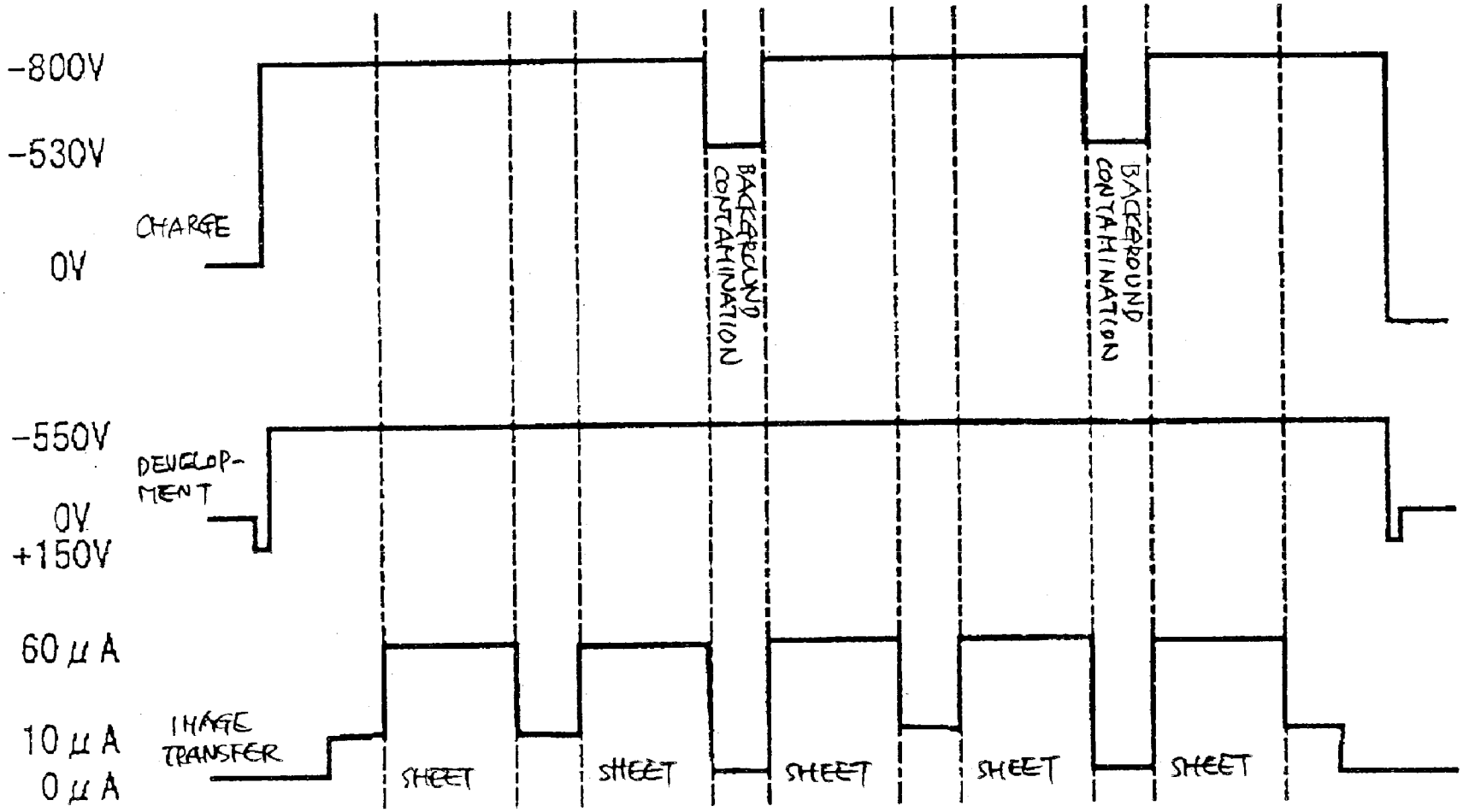
FIG. 16 is a timing chart showing a specific operation of the modifications shown in FIGS. 14 and 15.

More specifically, as shown in FIG. 16, a bias for image transfer is lowered in the condition shown in FIG. 12 wherein the charge potential is lowered. When an image is formed in a non-image portion after a preselected number of prints have been output, the bias for image transfer is lowered from one assigned to an image portion. This is successful to cause a minimum of toner to be transferred to the belt or the roller.

Figure 17:
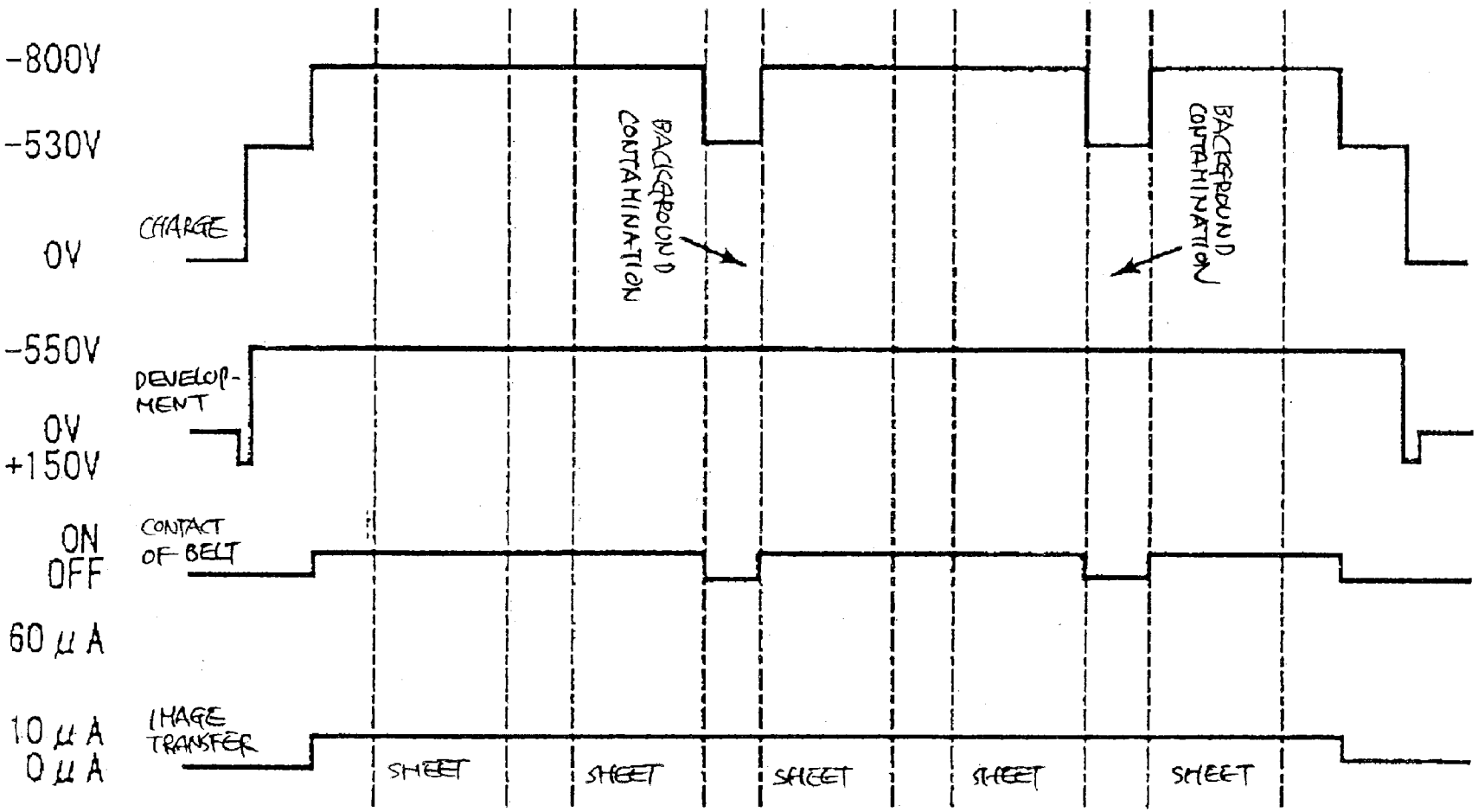
FIG. 17 is a timing chart showing another specific operation of the modifications shown in FIGS. 14 and 15.

FIG. 17 is a timing chart demonstrating how the belt of the contact type of image transferring device 60 is moved into and out of contact with the drum 20. As shown, the bias for image transfer is lowered in synchronism with the movement of the belt, particularly the release of the belt effected when a non-image portion is brought to the image transferring device 7.

Another modification of the illustrative embodiment will be described hereinafter. Briefly, in the modification to be described, an image is formed in a non-image portion just after the power-up of the printer 1A, but before the start of the initial image forming cycle, and/or after the last image has been formed in order to obviate the following occurrence. The fur brush 18A is constantly held in contact with the drum 20 up to the formation of an image. Therefore, if the amount of toner deposited on the fur brush 18A has decreased before the formation of an image in an image portion, then the tips of the fur brush 18A directly contact and rub the drum 20, bringing about triboelectrification.

Figure 18:
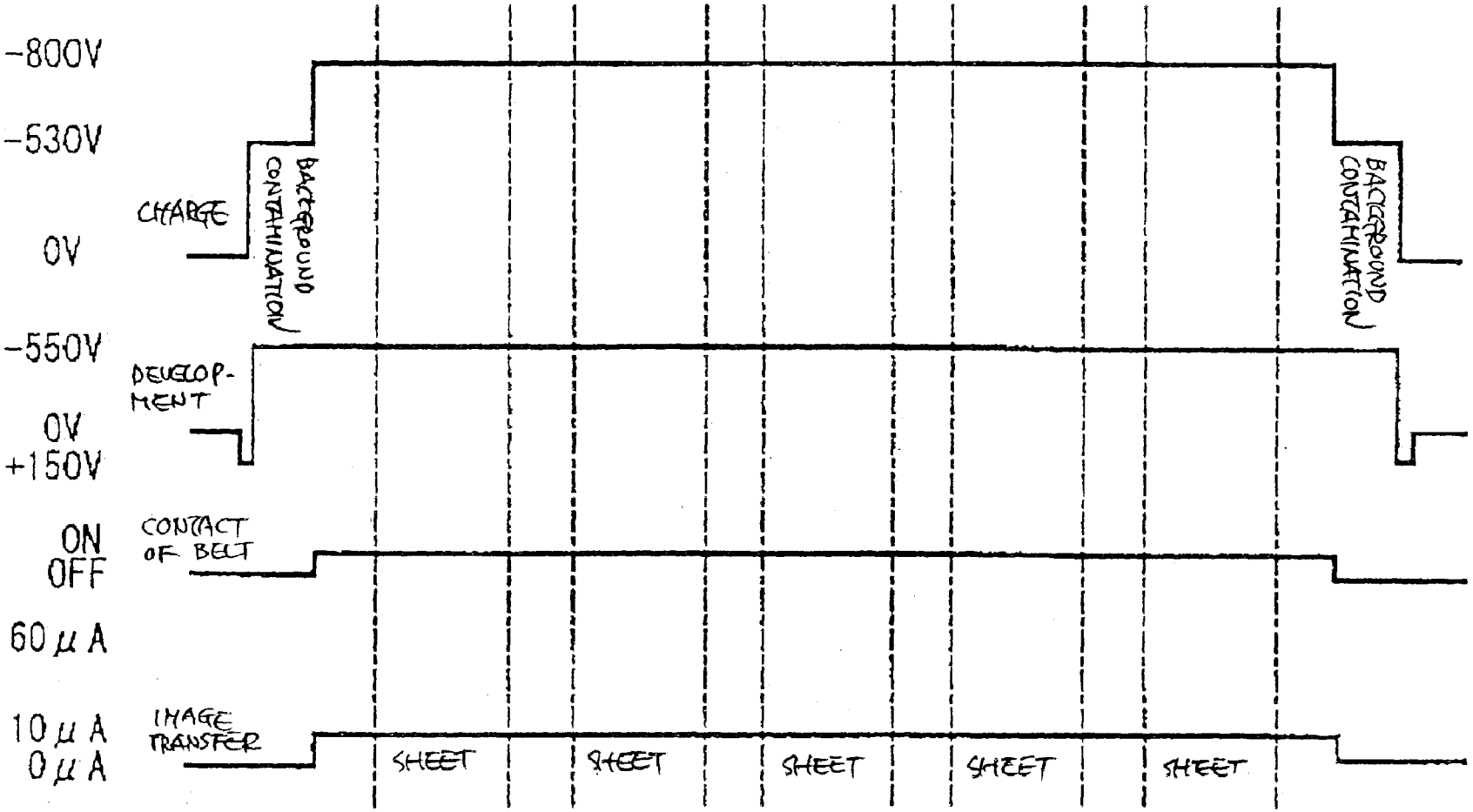
FIG. 18 is a timing chart showing a further specific operation of the modifications shown in FIGS. 14 and 15.

More specifically, as shown in FIG. 18, the charge potential is lowered from one assigned to an image portion before the start of the initial image forming cycle and after the formation of the last image, establishing a condition that allows toner to easily deposit in a non-image portion. In this condition, as in the condition shown in FIG. 12, the amount of toner deposited on the brush of the cleaning device is prevented from noticeably varying or decreasing, so that the tips of the fur brush 17A do not directly contact the drum 20.

In the specific cases shown in FIGS. 16 through 18, the bias for image transfer is selected to be 0 $\mu$A on the assumption that use is made of toner charged to negative polarity. Alternatively, use may, of course, be made of a positive bias slightly lower than one assigned to an image portion or a bias opposite in polarity to the same in matching relation to the charging characteristics of toner and the electric characteristics of the member of the image transferring device 7.

In the timing chart of FIG. 17, the belt of the image transferring device 60 is selectively moved into or out of contact with the drum 20. Therefore, it is possible to form an image in a non-image portion in the same condition as in an image portion when the belt is released from the drum 20. This makes it needless to vary the charge potential or the bias for image transfer.

As stated above, the illustrative embodiment and modifications thereof have various unprecedented advantages, as enumerated below.

(1) The contact of the looped tips of the brush with the drum, particularly the amount of bite of the tips into the drum, can be controlled to a value necessary for removing residues from the drum. The brush can therefore efficiently remove residues.

(2) The tips of the brush, contacting the drum with preselected pressure, are prevented from scratching or otherwise damaging the drum.

(3) The surface of the drum is hard enough to cope with the contact of the tips of the brush.

(4) An image is formed in a non-image portion independently of an image formed in an image portion, so that cleaning can be evenly effected in both of the image portion and non-image portion. This prevents the amount of developer to reach the cleaning step from noticeably varying and thereby reduces the triboelectrification of the drum ascribable to the direct contact of the tips of the brush.

(5) An optical writing unit, which is easy to control, writes a latent image in a non-image portion in such a condition that the amount of collected developer differs little between an image portion and a non-image portion. This is successful to achieve the above advantage (4).

(6) An image is formed in a non-image portion under conditions assigned to usual image formation. It is therefore possible to free the drum from an irregular potential distribution by using a conventional configuration.

(7) In a contact type of image transferring device, by varying an image transfer condition or releasing the device from the drum, it is possible to transfer of an image from a non-image portion to the device and therefore to obviate contamination of the device and that of the reverse surface of the next sheet. In addition, the collection ratio of residues by the cleaning device is prevented from noticeably varying, so that the direct contact of the brush with the drum is controlled.

(8) When an image is formed in a non-image portion before the start of the initial image forming cycle, the contact of the brush with the drum is optimized for thereby obviating a defective image ascribable to the irregular charging of the drum on the start of image formation.

Various modifications will become possible for those skilled in the art after receiving the teachings of the present disclosure without departing from the scope thereof. For example, any one of the cleaning devices shown and described may be constructed into a process cartridge removable from the image forming apparatus and including at least a photoconductive element.

What is claimed is:

1. A cleaning device for cleaning an image carrier by removing toner and other residues left on said image carrier, said cleaning device comprising:

a brush having tips, which contact a surface of said image carrier, provided with a loop configuration and a contact pressure of 50 g/cm$^2$; and a toner collecting space located at a position adjacent to said brush and at which the tips of said brush contacted the surface of said image carrier arrive in accordance with movement of said brush.

2. The cleaning device as claimed in claim 1, wherein said toner collecting space includes a slant positioned below said brush at a side opposite to said image carrier with respect to said brush, and a top portion of said slant is inclined away from said brush.

3. The cleaning device as claimed in claim 1, wherein said toner collecting space includes a slant positioned below said brush at a side opposite to said image carrier with respect to said brush and comprising an elastic sheet, and a top portion of said slant is inclined away from said brush.

4. The cleaning device as claimed in claim 1, wherein said brush is rotatable in a direction opposite to a direction in which said image carrier is rotatable.

5. In an image forming apparatus comprising a cleaning device for cleaning an image carrier by removing toner and other residues left on said image carrier, said cleaning device comprising:

a brush having tips, which contact a surface of said image carrier, provided with a loop configuration and a contact pressure of 50 g/cm$^2$; and a toner collecting space located at a position adjacent to said brush and at which the tips of said brush contacted the surface of said image carrier arrive in accordance with movement of said brush.

6. In a cleaning device comprising a cleaning member configured to remove residues left on a photoconductive element after image transfer, said cleaning member has tips comprising a loop configuration and facing and capable of contacting said photoconductive element, and said cleaning member contacts said photoconductive element with a contact pressure of 50 g/cm$^2$ or above.

7. In an image forming apparatus using a cleaning device comprising a cleaning member that is configured to remove residues left on a photoconductive element after image transfer, said photoconductive element has a surface having a belt coefficient of friction of 0.2$\mu$ or above, said cleaning member has tips facing and capable of contacting said photoconductive element, and said cleaning member contacts said photoconductive element with a contact pressure of 50 g/cm$^2$ or above.

8. The apparatus as claimed in claim 7, wherein said photoconductive element is formed of amorphous silicon.

9. The apparatus as claimed in claim 7, wherein an image to be developed is formed in a non-image portion of said photoconductive element.

10. The apparatus as claimed in claim 9, wherein the image is formed in the non-image portion such that a developer is capable of being evenly removed by cleaning.

11. The apparatus as claimed in claim 9, wherein the image is formed in the non-image portion when an area of an image formed in an image portion is smaller than a reference area.

12. The apparatus as claimed in claim 9, wherein the image formed in the non-image area is provided with an image density corresponding to an amount of writing in a main scanning direction of said photoconductive element.

13. The apparatus as claimed in claim 9, wherein the image in the non-image portion is derived from a latent image formed by optical writing.

14. The apparatus as claimed in claim 9, wherein to form the image in the non-image portion, at least one of a charge potential, a bias for development, and a bias for image transfer different from a charge potential is used.

15. The apparatus as claimed in claim 9, wherein, when an image transferring device for transferring an image from an image portion of said photoconductive element is of a type contacting said photoconductive element, at least one of an image transfer condition is varied or said image transferring device is released from said photoconductive element when the image formed in the non-image portion passes an image transfer position.

16. The apparatus as claimed in claim 9, wherein the image is formed in the non-image portion at at least either one of a time preceding first image formation and a time following last image formation.

17. In a process cartridge for a cleaning device for cleaning an image carrier by removing toner and other residues left on said image carrier, said cleaning device comprising:

a brush having tips, which contact a surface of said image carrier, provided with a loop configuration and a contact pressure of 50 g/cm$^2$; and a toner collecting space located at a position adjacent to said brush and at which the tips of said brush contacted the surface of said image carrier arrive in accordance with movement of said brush.

18. The process cartridge as claimed in claim 17, wherein said toner collecting space includes a slant positioned below said brush at a side opposite to said image carrier with respect to said brush, and a top portion of said slant is inclined away from said brush.

19. The process cartridge as claimed in claim 18, wherein said toner collecting space includes a slant positioned below said brush at a side opposite to said image carrier with respect to said brush and comprising an elastic sheet, and a top portion of said slant is inclined away from said brush.

20. The process cartridge as claimed in claim 18, wherein said brush is rotatable in a direction opposite to a direction in which said image carrier is rotatable.

* * * * *